US011473460B2

(12) United States Patent
Tan et al.

(10) Patent No.: US 11,473,460 B2
(45) Date of Patent: Oct. 18, 2022

(54) CONTROLLER FOR MOTOR-DRIVEN OIL PUMP AND METHOD FOR CONTROLLING MOTOR-DRIVEN OIL PUMP

(71) Applicant: TOYOTA JIDOSHA KABUSHIKI KAISHA, Toyota (JP)

(72) Inventors: Guodong Tan, Toyota (JP); Masahide Ichikawa, Nagakute (JP); Tetsuya Yamaguchi, Anjo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/342,711

(22) Filed: Jun. 9, 2021

(65) Prior Publication Data

US 2022/0010703 A1 Jan. 13, 2022

(30) Foreign Application Priority Data

Jul. 8, 2020 (JP) ..... JP2020-117667

(51) Int. Cl.
*F01M 9/00* (2006.01)
*F01M 1/16* (2006.01)
*F01M 1/02* (2006.01)

(52) U.S. Cl.
CPC ..... *F01M 1/16* (2013.01); *F01M 1/02* (2013.01); *F01M 2001/0215* (2013.01); *F01M 2001/0269* (2013.01); *F01M 2250/60* (2013.01)

(58) Field of Classification Search
CPC ..... F16H 61/0031; F16H 61/0025; B60W 20/00; F02D 2200/023; F04B 17/03; F04B 49/06
USPC ..... 184/6.1
See application file for complete search history.

(56) References Cited

U.S. PATENT DOCUMENTS

2004/0029677 A1* 2/2004 Mori ..... F16H 61/0031 477/3
2011/0276240 A1* 11/2011 Fujiwara ..... F16H 61/0021 701/59
2012/0141297 A1* 6/2012 Jeong ..... B60W 30/18018 903/930
2016/0121881 A1* 5/2016 Kim ..... B60W 10/02 180/65.265
2019/0136854 A1* 5/2019 Watanabe ..... H02P 29/0241
2019/0271303 A1* 9/2019 Endo ..... F04C 14/28

FOREIGN PATENT DOCUMENTS

JP H08-14076 A 1/1996

* cited by examiner

*Primary Examiner* — Long T Tran
*Assistant Examiner* — James J Kim
(74) *Attorney, Agent, or Firm* — Oblon, McClelland, Maier & Neustadt, L.L.P.

(57) ABSTRACT

A controller controls a motor-driven oil pump of a vehicle. The vehicle includes an engine, a mechanical oil pump, a battery, a motor-driven oil pump driven by a driving voltage applied by the battery, and a hydraulic device. The controller includes processing circuitry. The processing circuitry controls the driving voltage in a stop period during which the engine automatically stops and automatically restarts. The stop period includes a first period starting when the engine automatically stops and continuing until cranking starts and a second period starting when the cranking starts and continuing until the engine automatically restarts. The driving voltage in the first period is less than the driving voltage in the second period.

5 Claims, 5 Drawing Sheets

CONTROLLER FOR MOTOR-DRIVEN OIL PUMP AND METHOD FOR CONTROLLING MOTOR-DRIVEN OIL PUMP

BACKGROUND

1. Field

The present disclosure relates to a controller for a motor-driven oil pump and a method for controlling the motor-driven oil pump.

2. Description of Related Art

A vehicle described in Japanese Laid-Open Patent Publication No. 08-014076 includes an automatic transmission, a mechanical oil pump driven by the crankshaft of an engine, and a motor-driven oil pump driven in accordance with a driving voltage of a battery. The motor-driven oil pump supplies oil to the clutch of the automatic transmission in a period during which the engine automatically stops and automatically restarts. As a result, in the period during which the engine automatically stops and automatically restarts, the pressure of the oil supplied to the clutch is maintained.

In the period during which the engine automatically stops and automatically restarts, the engine does not generate noise that accompanies driving, causing noise that accompanies the driving of the motor-driven oil pump to be noticeable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a controller for a motor-driven oil pump of a vehicle is provided. The vehicle includes an engine, a mechanical oil pump configured to be driven by a crankshaft of the engine, a battery configured to be recharged by a rotational force of the crankshaft, a motor-driven oil pump configured to be driven by a driving voltage applied by the battery, and a hydraulic device configured to be driven when supplied with oil from the mechanical oil pump and the motor-driven oil pump. The controller includes processing circuitry. The processing circuitry includes a voltage control unit configured to control the driving voltage in a stop period during which the engine automatically stops and automatically restarts. The stop period includes a first period starting when the engine automatically stops and continuing until cranking starts and a second period starting when the cranking starts and continuing until the engine automatically restarts. The voltage control unit is configured to control the driving voltage so that the driving voltage in the first period is less than the driving voltage in the second period.

In another general aspect, a method for controlling a motor-driven oil pump of a vehicle is provided. The vehicle includes an engine, a mechanical oil pump configured to be driven by a crankshaft of the engine, a battery configured to be recharged by a rotational force of the crankshaft, a motor-driven oil pump configured to be driven by a driving voltage applied by the battery, and a hydraulic device configured to be driven when supplied with oil from the mechanical oil pump and the motor-driven oil pump. The method includes controlling the driving voltage in a first period starting when the engine automatically stops and continuing until cranking starts, and controlling the driving voltage in a second period starting when the cranking starts and continuing until the engine automatically restarts. The driving voltage in the first period is less than the driving voltage in the second period.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A controller for a motor-driven oil pump according to one embodiment will now be described with reference to the drawings. The configuration of a vehicle 100 is described first.

Figure 1:
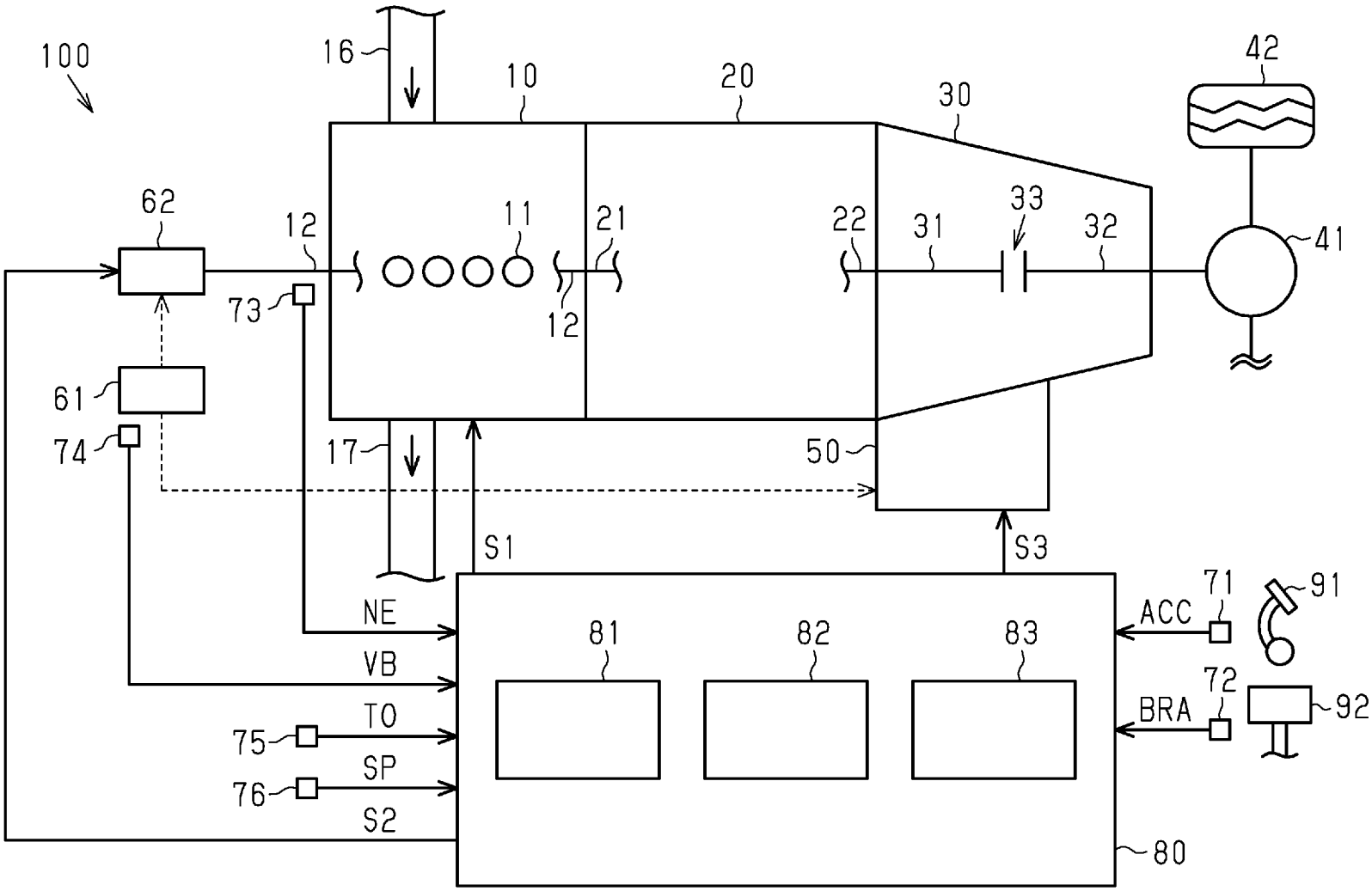
FIG. 1 is a diagram of a vehicle.

As shown in FIG. 1, the vehicle 100 includes an engine 10, an intake passage 16, an exhaust passage 17, a torque converter 20, an automatic transmission 30, a differential gear 41, drive wheels 42, a hydraulic mechanism 50, a battery 61, and a starter motor 62.

The engine 10 includes four cylinders 11 and a crankshaft 12. The intake passage 16 is connected to the engine 10. Intake air outside the vehicle 100 is drawn through the intake passage 16 into the cylinders 11. The exhaust passage 17 is connected to the engine 10. Exhaust gas from the cylinders 11 is discharged through the exhaust passage 17.

The torque converter 20 is fixed to the engine 10. The torque converter 20 includes an input shaft 21 and an output shaft 22. One end of the input shaft 21 is connected to the crankshaft 12. The other end of the input shaft 21 is connected to the output shaft 22 by a lockup clutch (not shown).

The automatic transmission 30 is fixed to the torque converter 20. The automatic transmission 30 is a multi-gear automatic transmission with planetary gear trains. The automatic transmission 30 includes an input shaft 31, an output shaft 32, and clutches 33. FIG. 1 shows one of the clutches 33.

One end of the input shaft 31 is connected to the output shaft 22. The other end of the input shaft 31 is connected to one end of the output shaft 32 by the clutches 33. The other end of the output shaft 32 is connected by the differential gear 41 to the drive wheels 42 arranged at the right and left side of the vehicle 100. The clutches 33 are configured to switch between an engagement state and a disengagement state in accordance with the pressure of oil supplied to the clutches 33. Specifically, when the pressure of the oil supplied to the clutches 33 increases, the clutches 33 are switched from the disengagement state to the engagement state. The maximum torque that the clutches 33 can transmit increases as the pressure of the oil supplied to the clutch 33 increases. When the clutches 33 change the engagement state and the disengagement state of the clutches, the gear of the automatic transmission 30 is shifted. When the gear of the automatic transmission 30 is shifted, the gear ratio of the automatic transmission 30 is changed. The clutches 33 are an example of a hydraulic device.

The hydraulic mechanism 50 filled with oil is attached to the automatic transmission 30. The hydraulic mechanism 50 controls the pressure of oil supplied to the clutches 33 to change the engagement state and the disengagement state of the clutches 33.

Figure 2:
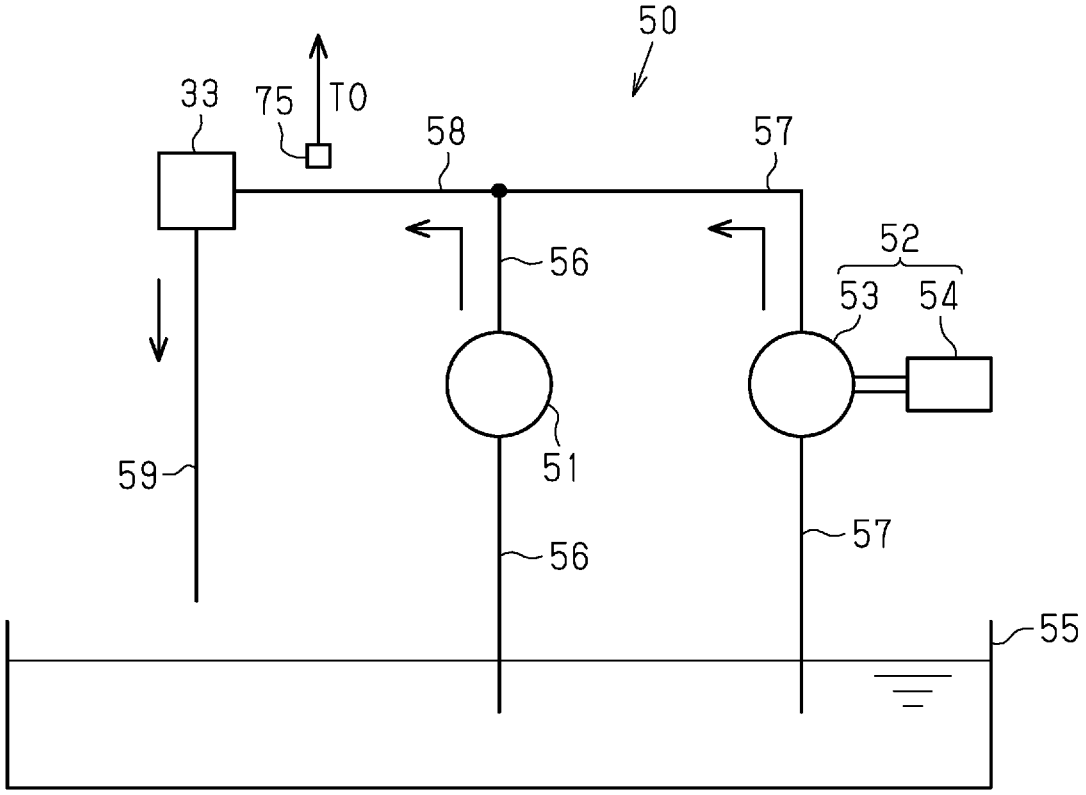
FIG. 2 is a diagram showing a clutch and a hydraulic mechanism.

As shown in FIG. 2, the hydraulic mechanism 50 includes a mechanical oil pump 51, a motor-driven oil pump 52, an oil pan 55, a first suction passage 56, a second suction passage 57, an integrated passage 58, and a discharging passage 59. The oil pan 55 stores oil supplied to the clutches 33. One end of the first suction passage 56 is arranged inside the oil pan 55. The other end of the first suction passage 56 is connected to the integrated passage 58. One end of the second suction passage 57 is arranged inside the oil pan 55. The other end of the second suction passage 57 is connected to a portion of the integrated passage 58 to which the first suction passage 56 is connected. The integrated passage 58 is connected to the clutches 33. The discharging passage 59 is connected to the clutches 33.

The mechanical oil pump 51 is attached to a middle portion of the first suction passage 56. The mechanical oil pump 51 is connected to the crankshaft 12 (not shown). The crankshaft 12 is rotated to drive the mechanical oil pump 51. The driven mechanical oil pump 51 suctions oil from the oil pan 55 through the first suction passage 56 so that the oil enters the mechanical oil pump 51. The oil, which has entered the mechanical oil pump 51, is discharged by the mechanical oil pump 51 and enters the clutches 33 through the first suction passage 56 and the integrated passage 58. The oil flows in the clutches 33 and returns to the oil pan 55 through the discharging passage 59.

The motor-driven oil pump 52 includes a pump body 53 and an electric motor 54. The pump body 53 is attached to a middle portion of the second suction passage 57. The pump body 53 is connected to the output shaft of the electric motor 54. The output shaft of the electric motor 54 rotates to drive the pump body 53. The driven pump body 53 suctions oil from the oil pan 55 through the second suction passage 57 so that the oil enters the pump body 53. The oil, which has entered the pump body 53, is discharged by the pump body 53 and enters the clutches 33 through the second suction passage 57 and the integrated passage 58. The oil flows in the clutches 33 and returns to the oil pan 55 through the discharging passage 59.

As shown in FIG. 1, the battery 61 supplies power to the electric motor 54 of the motor-driven oil pump 52. The battery 61 also supplies power to the starter motor 62. The battery 61 is recharged by an alternator (not shown) using the rotational force of the crankshaft 12. The starter motor 62 is connected to the crankshaft 12. The starter motor 62 rotates the crankshaft 12, which will be referred to as cranking, to start the engine 10.

The vehicle 100 includes an accelerator pedal 91 that is operated by a driver to accelerate the vehicle 100. The vehicle 100 includes a braking pedal 92 that is operated by the driver to decelerate the vehicle 100.

The vehicle 100 includes an accelerator position sensor 71, a braking position sensor 72, a crank rotation speed sensor 73, a voltage sensor 74, a temperature sensor 75, and a vehicle speed sensor 76. The accelerator position sensor 71 is arranged near the accelerator pedal 91. The accelerator position sensor 71 detects an accelerator operation amount ACC that indicates the amount of operation of the accelerator pedal 91 operated by the driver. The braking position sensor 72 is arranged near the braking pedal 92. The braking position sensor 72 detects a braking operation amount BRA that indicates the amount of operation of the braking pedal 92 operated by the driver. The crank rotation speed sensor 73 is arranged near the crankshaft 12. The crank rotation speed sensor 73 detects an engine speed NE that indicates the rotation speed of the crankshaft 12.

As shown in FIG. 1, the voltage sensor 74 detects a battery voltage VB that indicates the terminal-to-terminal voltage of the battery 61. As shown in FIG. 2, the temperature sensor 75 is arranged for the integrated passage 58. The temperature sensor 75 detects an oil temperature TO that indicates the temperature of oil flowing in the integrated passage 58, that is, the temperature of oil discharged by the motor-driven oil pump 52. As shown in FIG. 1, the vehicle speed sensor 76 detects a vehicle speed SP that indicates the speed of the traveling vehicle 100.

As shown in FIG. 1, the vehicle 100 includes a controller 80. The controller 80 receives signals of the accelerator operation amount ACC, the braking operation amount BRA, the engine speed NE, the battery voltage VB, the oil temperature TO, and the vehicle speed SP respectively from the accelerator position sensor 71, the braking position sensor 72, the crank rotation speed sensor 73, the voltage sensor 74, the temperature sensor 75, and the vehicle speed sensor 76.

The controller 80 includes a control unit 81, a voltage obtaining unit 82, and a temperature obtaining unit 83. The voltage obtaining unit 82 obtains the battery voltage VB from the voltage sensor 74. The temperature obtaining unit 83 obtains the oil temperature TO from the temperature sensor 75.

The control unit 81 controls the engine 10 based on the accelerator operation amount ACC and the like. Specifically, the control unit 81 outputs a control signal S1 to the engine 10 so as to control the fuel injection amount of fuel injection valves or the opening degree of a throttle valve in the engine 10. The control unit 81 also outputs a control signal S2 to the starter motor 62 so as to control the starter motor 62.

The control unit 81 automatically stops the engine 10 and automatically restarts the engine 10 based on the accelerator operation amount ACC, the braking operation amount BRA, and the vehicle speed SP. Specifically, the control unit 81 automatically stops the engine 10 when preset automatic stop conditions are satisfied. When the automatic stop conditions are satisfied, for example, a condition in which the accelerator operation amount ACC is 0, a condition in which the braking operation amount BRA is greater than 0, and a condition in which the vehicle speed SP is 0 are all satisfied. When the control unit 81 determines that the automatic stop conditions are satisfied, the control unit 81 sets the fuel injection amount of the fuel injection valves to 0. This results in an automatic stop of the engine 10. Then, when the control unit 81 determines that the automatic stop conditions are no longer satisfied, for example, when the braking operation amount BRA becomes 0, the control unit 81 drives the starter motor 62 to perform cranking and injects fuel from the fuel injection valves. When preset completion conditions are satisfied, the control unit 81 stops the driving of the starter motor 62 to complete the automatic restart. When the completion conditions are satisfied, for example, a condition in which the engine speed NE becomes greater than or equal to a preset rotation speed for completion and a condition in which time that has elapsed from the start of the cranking becomes greater than or equal to a preset time are all satisfied. The preset rotation speed for completion may be a rotation speed at which the engine 10 can perform self-sustaining operation.

The control unit 81 controls the driving voltage that is applied from the battery 61 to the electric motor 54 in a stop period during which the engine 10 automatically stops and automatically restarts. Specifically, the control unit 81 outputs a control signal S3 to the electric motor 54 so as to control the driving voltage of the electric motor 54 under pulse width modulation (PWM) control. The driving voltage increases as the duty cycle under PWM control increases. The rotation speed of the output shaft of the electric motor 54 is changed in accordance with the driving voltage applied to the electric motor 54 so that the displacement of oil from the pump body 53 is changed. The displacement of oil from the pump body 53 increases as the driving voltage applied to the electric motor 54 increases. In the present embodiment, the control unit 81 serves as a voltage control unit. The PWM control alternately switches between an energized state and a de-energized state. The duty cycle is a ratio of the energized state to a cycle (pulse cycle) in which the energized state and the de-energized state are switched.

The controller 80 may be configured as processing circuitry including one or more processors that execute various types of processes according to a computer program (software). The controller 80 may also be configured as processing circuitry including one or more dedicated hardware circuits such as application specific integrated circuits (ASIC) that execute at least part of various types of processes or a combination thereof. The processor includes a CPU and memory such as RAM and ROM. The memory stores program codes or instructions configured to cause the CPU to execute processes. The memory, or computer readable media, includes any type of media that are accessible by versatile computers or dedicated computers.

The stop period control executed by the controller 80 when the engine 10 is in a stop period will now be described. When the controller 80 determines that the engine 10 has automatically stopped, the controller 80 starts executing the stop period control. Specifically, when the controller 80 determines that the automatic stop conditions and a condition in which the engine speed NE is less than or equal to a preset rotation speed for stop are all satisfied, the controller 80 determines that the engine 10 has automatically stopped. The preset rotation speed for stop may be, for example, 0 to 500 rpm, which is less than the preset rotation speed for completion. When the controller 80 determines that the engine 10 has automatically restarted, the controller 80 ends the stop period control. Specifically, when the completion conditions are satisfied, the controller 80 determines that the engine 10 has automatically restarted. The controller 80 repeatedly executes the stop period control from when determining that the engine 10 has automatically stopped until determining that the engine 10 has automatically restarted.

Figure 3:
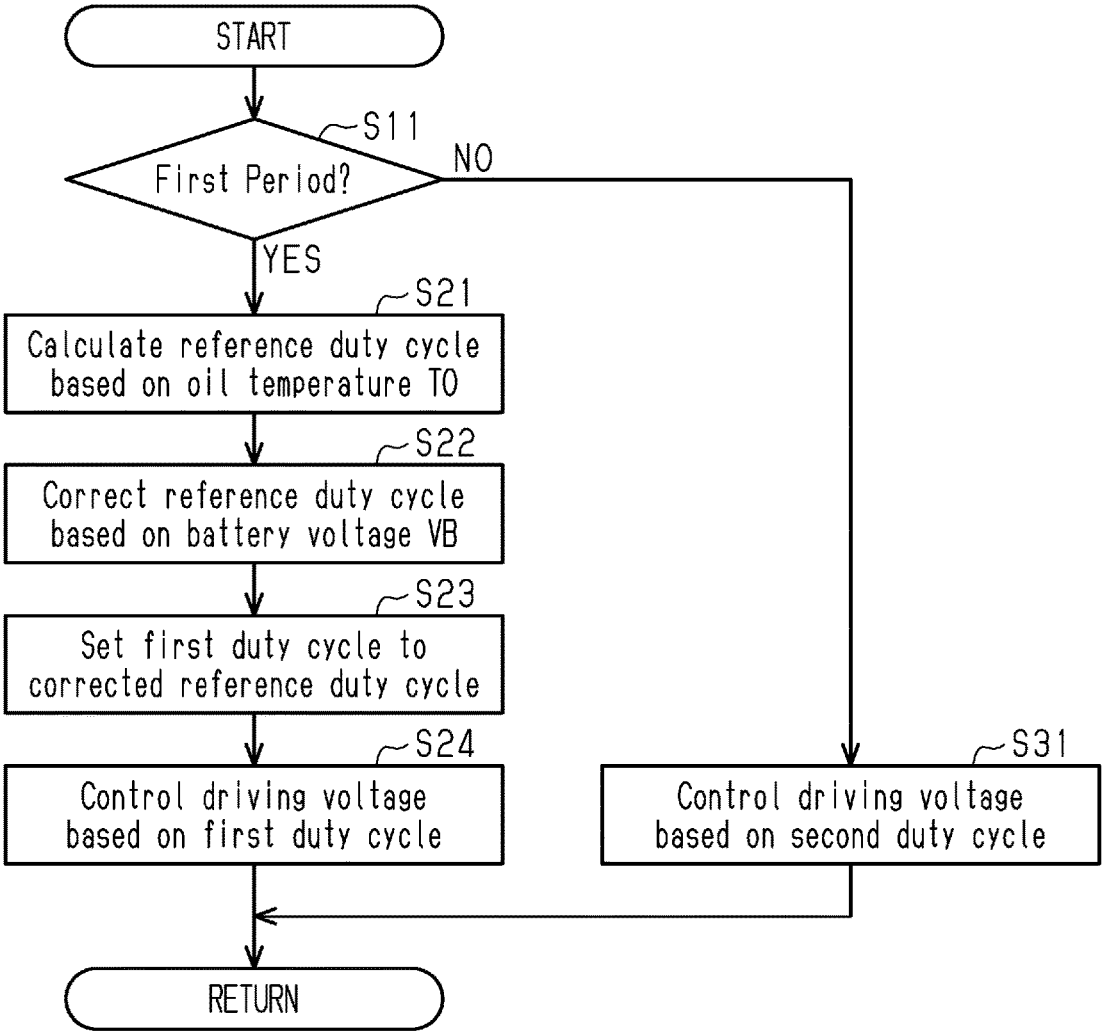
FIG. 3 is a flowchart showing stop period control executed by a controller.

As shown in FIG. 3, when the stop period control is started, in step S11, the control unit 81 determines whether a processing time in step S11 is in a first period. The first period is a segment of the stop period starting when the engine 10 automatically stops and continuing until cranking starts. In step S11, when the control unit 81 determines that the processing time in step S11 is in the first period (S11: YES), the control unit 81 advances the process to step S21.

Figure 4:
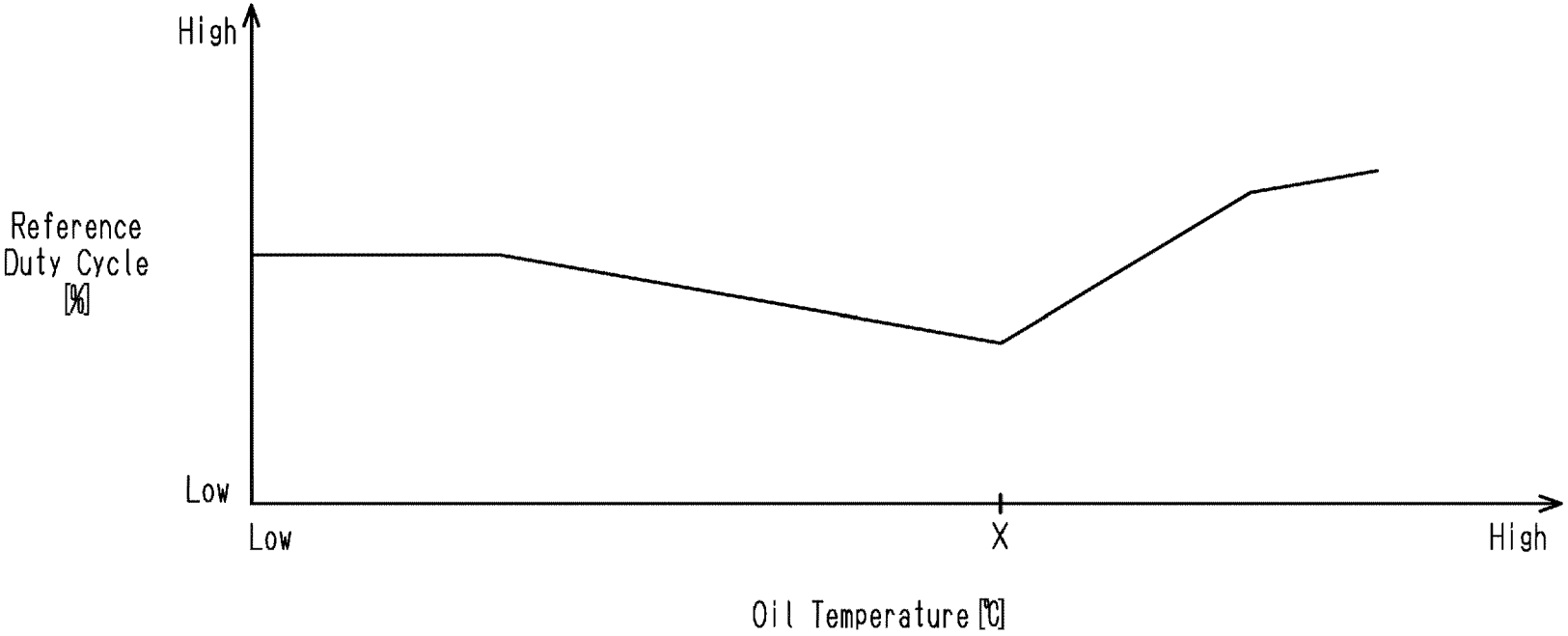
FIG. 4 is a graph showing the relationship between oil temperature and a reference duty cycle in a first period.

In step S21, the control unit 81 calculates a reference duty cycle based on the oil temperature TO. The control unit 81 stores a duty cycle map indicating the reference duty cycle in association with the oil temperature TO as represented by the solid line in FIG. 4.

The oil viscosity, the driving voltage of the motor-driven oil pump 52, the displacement of oil from the motor-driven oil pump 52, and the leakage of oil from the clutches 33 and the leakage of oil from an oil supply passage starting from the motor-driven oil pump 52 to the clutches 33 (both leakages will be collectively referred to as "oil leakage") have the following characteristics. The supply passage includes the second suction passage 57 and the integrated passage 58.

Characteristics (1): When the viscosity of oil increases, the amount of oil discharged from the motor-driven oil pump 52 decreases under the same driving voltage of the motor-driven oil pump 52.

Characteristics (2): When the viscosity of oil decreases, the oil leakage tends to increase. When the oil leakage increases, the pressure of oil supplied to the clutches 33 tends to decrease under the same displacement of oil from the motor-driven oil pump 52.

The duty cycle map is preset based on the above characteristics (1) and characteristics (2). Specifically, in the duty cycle map, when the oil temperature TO is in a temperature range that is lower than a preset temperature X that serves as a preset threshold value, the reference duty cycle in the first period increases as the oil temperature TO decreases. Further, in the duty cycle map, when the oil temperature TO is in a temperature range that is higher than or equal to the preset temperature X, the reference duty cycle in the first period increases as the oil temperature TO increases. The preset temperature X is, for example, 80° C. The control unit 81 applies the oil temperature TO to the duty cycle map to calculate the reference duty cycle. Then, the control unit 81 advances the process to step S22.

In step S22, the control unit 81 corrects the reference duty cycle based on the battery voltage VB. The corrected reference duty cycle increases as the battery voltage VB decreases. Then, the control unit 81 advances the process to step S23.

In step S23, the control unit 81 sets a first duty cycle to the reference duty cycle corrected in step S22. The first duty cycle is, for example, 10 to 80%. Then, the control unit 81 advances the process to step S24.

In step S24, the control unit 81 controls the driving voltage of the electric motor 54 based on the first duty cycle. This changes the displacement of oil from the pump body 53 in accordance with the driving voltage of the electric motor 54. Then, the control unit 81 repeats the process from step S11.

In step S11, when the control unit 81 determines that the processing time in step S11 is not in the first period (S11: NO), the control unit 81 advances the process to step S31. In other words, the control unit 81 advances the process to step S31 when the processing time in the first step S11 is in a second period of the stop period. The second period starts when cranking starts and continues until the engine 10 automatically restarts.

In step S31, the control unit 81 controls the driving voltage of the electric motor 54 based on a preset second duty cycle. This changes the displacement of oil from the pump body 53 in accordance with the driving voltage of the electric motor 54. The second duty cycle is higher than the first duty cycle. The second duty cycle is, for example, 90 to 100%. That is, the displacement of oil from the pump body 53 in the second period is the maximum value or close to the maximum value. Then, the control unit 81 repeats the process from step S11.

The operation of the present embodiment will now be described.

Figure 5:
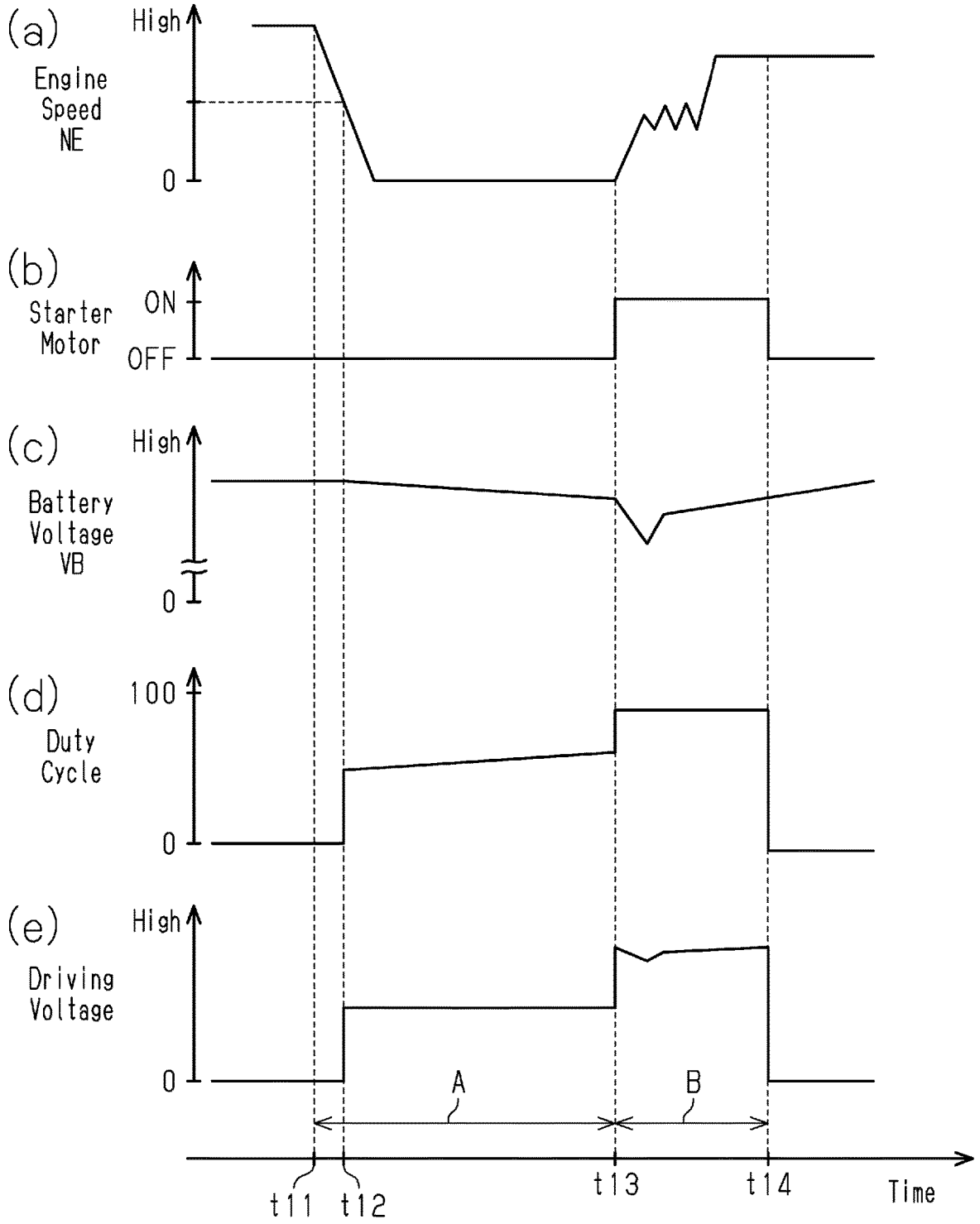
FIG. 5 is a time chart showing (a) changes in an engine speed NE, (b) changes in the driving state of a starter motor, (c) changes in a battery voltage VB, (d) changes in a duty cycle, and (e) changes in a driving voltage.

As shown in (a) of FIG. 5, before time t11, the automatic stop conditions of the engine 10 are not satisfied and the engine 10 is in operation. When the automatic stop conditions of the engine 10 are satisfied at time t11, the fuel injection amount of the fuel injection valve becomes 0. This gradually decreases the engine speed NE after time t11.

When the engine speed NE becomes less than or equal to the preset rotation speed for stop at time t12, the stop period control is executed and the motor-driven oil pump 52 is driven. As shown in (c) of FIG. 5, in the period from time t12 to time t13, the driving of the motor-driven oil pump 52 gradually decreases the battery voltage VB. As shown in (d) of FIG. 5, in the period from time t12 to time t13, the correction of the duty cycle in accordance with the battery voltage VB gradually increases the duty cycle. This maintains the driving voltage at a fixed value in the period from time t12 to time t13 as shown in (e) of FIG. 5.

As shown in (b) of FIG. 5, when the automatic stop conditions are no longer satisfied at time t13, the starter motor 62 is driven to perform cranking. In this case, as shown in (c) of FIG. 5, immediately after time t13, the driving of the starter motor 62 temporarily decreases the battery voltage VB. As shown in (d) of FIG. 5, the second duty cycle in the period from time t13 to time t14 is higher than the first duty cycle in the period from time t12 to time t13. As a result, even when the decline in the battery voltage VB somewhat decreases the driving voltage of the electric motor 54, as shown in (e) of FIG. 5, the overall driving voltage of the electric motor 54 in the period from time t13 to time t14 is higher than the driving voltage in the period from time t12 to time t13.

As shown in (a) of FIG. 5, the injection of fuel from the fuel injection valves gradually increases the engine speed NE. When the completion conditions are satisfied at time t14, the execution of the stop period control ends.

The advantages of the present embodiment will now be described.

(1) As shown in (e) of FIG. 5, the driving voltage of the electric motor 54 in the first period A from time t12 to time t13 is lower than the driving voltage in the second period B from time t13 to time t14. Thus, compared to the second period B in which noise is generated by the operation of the engine 10 (referred to as "engine noise"), noise generated by the driving of the motor-driven oil pump 52 (referred to as "pump noise") is smaller in the first period A in which the engine noise is not generated. The pump noise in the second period B is likely to be masked by the engine noise. This allows the pump noise to be less noticeable.

The driving voltage of the motor-driven oil pump 52 in the second period B is higher than the driving voltage of the motor-driven oil pump 52 in the first period A. Thus, there is more displacement of oil from the motor-driven oil pump 52 in the second period B than in the first period A. In the second period B, the engine 10 does not automatically restart while cranking is performed. Thus, oil supplied by the mechanical oil pump 51 to the clutches 33 tends to be insufficient. Oil discharged by the motor-driven oil pump 52 can compensate for the insufficiency of oil supplied by the mechanical oil pump 51 to the clutches 33.

(2) The viscosity of oil has characteristics (1). Thus, when the oil temperature TO is in the temperature range that is lower than the preset temperature X, as the oil temperature TO decreases and the viscosity of oil increases, the amount of oil discharged from the motor-driven oil pump 52 decreases under the same driving voltage of the motor-driven oil pump 52.

In this respect, when the oil temperature TO is in the temperature range that is lower than the preset temperature X, the reference duty cycle in the first period A calculated from the duty cycle map increases as the oil temperature TO decreases. The driving voltage in the first period A increases as the oil temperature TO decreases. This restricts a decline in the displacement of oil from the motor-driven oil pump 52 when the above characteristics (1) result in the high viscosity of oil.

The viscosity of oil has characteristics (2). Thus, when the oil temperature TO is in the temperature range that is higher than or equal to the preset temperature X, the oil leakage is likely to increase as the oil temperature TO increases and the viscosity of oil decreases. When the oil leakage increases, the pressure of oil supplied to the clutches 33 tends to decrease under the same displacement of oil from the motor-driven oil pump 52.

In this respect, when the oil temperature TO is in the temperature range that is higher than or equal to the preset temperature X, the reference duty cycle in the first period A calculated from the duty cycle map increases as the oil temperature TO increases. The driving voltage in the first period A increases as the oil temperature TO increases. This allows the motor-driven oil pump 52 to discharge oil that compensates for an increase in oil leakage when the above characteristics (2) result in the low viscosity of oil.

Thus, the present embodiment restricts problems resulting from the above characteristics (1) and (2). As a result, the pressure of oil supplied to the clutches 33 is regulated to have the pressure suitable for actuating the clutches 33.

(3) When the duty cycle is constant, the driving voltage of the electric motor 54 decreases as the battery voltage VB decreases. Thus, when a decline in the battery voltage VB decreases the driving voltage of the electric motor 54, the displacement of oil from the motor-driven oil pump 52 may be decreased.

In this respect, the first duty cycle in the first period A increases as the battery voltage VB decreases. This increases the duty cycle even when the battery voltage VB decreases so that the driving voltage of the electric motor 54 is less likely to decrease. This restricts a decline in the displacement of oil from the motor-driven oil pump 52 in the first period A when the battery voltage VB decreases.

The present embodiment may be modified as described below. The present embodiment and the following modifications can be combined as long as the combined modifications remain technically consistent with each other.

In the above embodiment, the conditions for determining an automatic stop of the engine 10 may be changed. For example, the controller 80 may determine that the engine 10 has automatically stopped when the automatic stop conditions of the engine 10 are satisfied regardless of the engine speed NE. In this case, the first period is from time t11 to time t13 in the example of FIG. 5. Further, when the controller 80 determines that the automatic stop conditions and a condition in which the engine speed NE is 0 are all satisfied, the controller 80 may determine that the engine 10 has automatically stopped. In this case, the first period starts when the engine speed NE becomes 0 after time t12 and continues until time t13 in the example of FIG. 5.

In the above embodiment, the conditions for determining an automatic restart of the engine 10 may be changed. For example, the controller 80 may determine that the engine 10 has automatically restarted when either one of a condition in which the engine speed NE becomes greater than or equal to a preset rotation speed for completion and a condition in which time that has elapsed from the start of cranking becomes greater than or equal to a preset time is satisfied. In the example of FIG. 5, the second period starts from time t13 and continues until the engine 10 is determined to have automatically started.

In the above embodiment, the driving voltage in the second period does not need to be higher than the driving voltage in the entire first period. For example, as shown in (a) of FIG. 5, the engine speed NE at the start of the second period B is less than the engine speed NE at the end of the second period B. Thus, the displacement of the mechanical oil pump 51 at the start of the second period B is less than the displacement at the end of the second period B. Accordingly, the displacement of the motor-driven oil pump 52 at start of the second period B may need to increase and the displacement of the motor-driven oil pump 52 at the end of the second period B may not need to increase. When restricting the insufficiency of oil supplied to the clutches 33, the driving voltage of the motor-driven oil pump 52 at the end of the second period B does not need to be higher than the driving voltage of the motor-driven oil pump 52 in the first period A. In this case, the driving voltage in a segment of the second period B before the end may be higher than the driving voltage of the motor-driven oil pump 52 in the first period A.

Further, as shown in (a) of FIG. 5, the engine speed NE at the start of the second period B is less than the engine speed NE at the end of the second period B. Thus, the engine noise at the start of the second period B is less than the engine noise at the end of the second period B. The pump noise at the start of the second period B is likely to be masked by the engine noise. When restricting the noticeable pump noise, the driving voltage of the motor-driven oil pump 52 at the start of the second period B does not need to be higher than the driving voltage of the motor-driven oil pump 52 in the first period A. In this case, the driving voltage in a segment of the second period B after the start may be higher than the driving voltage of the motor-driven oil pump 52 in the first period A.

In the above embodiment, the preset temperature X set in the duty cycle map may be changed in accordance with the configurations of the hydraulic mechanism 50 and the clutches 33.

In the above embodiment, the duty cycle map does not need to be set based on both the characteristics (1) and the characteristics (2). For example, when restricting the problem resulting solely from the above characteristics (1), the reference duty cycle in the first period, which is calculated from the duty cycle map, may increase as the oil temperature TO decreases regardless of the preset temperature X.

For example, when restricting the problem resulting solely from the above characteristics (2), the reference duty cycle in the first period, which is calculated from the duty cycle map, may increase as the oil temperature TO increases regardless of the preset temperature X.

In the above embodiment, the setting of the first duty cycle may be modified. For example, the reference duty cycle does not need to be corrected in accordance with the battery voltage VB. The first duty cycle may be set to the reference duty cycle calculated in step S21.

Further, the first duty cycle does not need to be calculated based on the oil temperature TO. Specifically, the first duty cycle may be a preset value lower than the second duty cycle.

In the above embodiment, the second duty cycle may be corrected in accordance with the oil temperature TO and the battery voltage VB. In this case, the driving voltage in the second period may be higher than the first period.

In the above embodiment, the driving voltage does not need to be controlled under PWM control. Instead, the driving voltage may be controlled by a step-down circuit or the like.

In the above embodiment, the temperature sensor 75 may be attached to a different location. For example, the temperature sensor 75 may be attached to the discharging passage 59 or the oil pan 55. In this case, the temperature of oil flowing in the discharging passage 59 or the temperature of oil stored in the oil pan 55 corresponds to the temperature of oil discharged from the motor-driven oil pump 52.

The hydraulic device is not limited to the clutches 33. For example, the hydraulic device may include a brake serving as a frictional engagement element that can switch between an engagement state and a disengagement state in an automatic transmission.

When the above embodiment includes a mechanical oil pump and a motor-driven oil pump used for the engine 10, the technique of the present application may be applied to the motor-driven oil pump of the engine 10.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for a motor-driven oil pump of a vehicle, wherein the vehicle includes an engine, a mechanical oil pump configured to be driven by a crankshaft of the engine, a battery configured to be recharged by a rotational force of the crankshaft, a motor-driven oil pump configured to be driven by a driving voltage applied by the battery, and a hydraulic device configured to be driven when supplied with oil from the mechanical oil pump and the motor-driven oil pump, the controller comprising processing circuitry, wherein the processing circuitry includes a voltage control unit configured to control the driving voltage in a stop period during which the engine automatically stops and automatically restarts, the stop period includes a first period starting when the engine automatically stops and continuing until cranking starts and a second period starting when the cranking starts and continuing until the engine automatically restarts, and the voltage control unit is configured to control the driving voltage so that the driving voltage in the first period is less than the driving voltage in the second period.

2. The controller according to claim 1, wherein the processing circuitry includes a temperature obtaining unit configured to obtain an oil temperature indicative of a temperature of oil discharged from the motor-driven oil pump, and the voltage control unit is configured to control the driving voltage in the first period based on the oil temperature.

3. The controller according to claim 2, wherein when the oil temperature is in a temperature range that is lower than a preset threshold value, the voltage control unit controls the driving voltage so that the driving voltage in the first period increases as the oil temperature decreases, and when the oil temperature is in a temperature range that is higher than or equal to the threshold value, the voltage control unit controls the driving voltage so that the driving voltage in the first period increases as the oil temperature increases.

4. The controller according to claim 1, wherein the processing circuitry includes a voltage obtaining unit configured to obtain a battery voltage indicative of a voltage of the battery, the voltage control unit is configured to convert the battery voltage into the driving voltage based on a duty cycle under pulse width modulation control, and the voltage control unit is configured to increase the duty cycle under the pulse width modulation control as the battery voltage decreases.

5. A method for controlling a motor-driven oil pump of a vehicle, wherein the vehicle includes an engine, a mechanical oil pump configured to be driven by a crankshaft of the engine, a battery configured to be recharged by a rotational force of the crankshaft, a motor-driven oil pump configured to be driven by a driving voltage applied by the battery, and a hydraulic device configured to be driven when supplied with oil from the mechanical oil pump and the motor-driven oil pump, the method comprising:

controlling the driving voltage in a first period starting when the engine automatically stops and continuing until cranking starts; and controlling the driving voltage in a second period starting when the cranking starts and continuing until the engine automatically restarts, wherein the driving voltage in the first period is less than the driving voltage in the second period.

* * * * *